US009500055B2

(12) United States Patent
Allen

(10) Patent No.: US 9,500,055 B2
(45) **Date of Patent: *Nov. 22, 2016**

(54) RESETTABLE SELECTIVE LOCKING DEVICE

(75) Inventor: Jason A. Allen, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 604 days.

This patent is subject to a terminal disclaimer.

(21) Appl. No.: 13/543,412

(22) Filed: Jul. 6, 2012

(65) Prior Publication Data

US 2014/0008052 A1 Jan. 9, 2014

(51) Int. Cl.

| | |
|---|---|
| ***E21B 23/02*** | (2006.01) |
| ***E21B 23/00*** | (2006.01) |
| ***E21B 43/04*** | (2006.01) |
| *E21B 17/02* | (2006.01) |

(52) U.S. Cl.

CPC ..... *E21B 23/004* (2013.01); *E21B 23/02* (2013.01); *E21B 43/04* (2013.01); *E21B 17/02* (2013.01)

(58) Field of Classification Search

CPC .... E21B 23/00; E21B 23/004; E21B 23/006; E21B 43/04; E21B 43/045

See application file for complete search history.

(56) References Cited

U.S. PATENT DOCUMENTS

| | | | | |
|---|---|---|---|---|
| 5,390,735 | A | 2/1995 | Williamson, Jr. | |
| 6,382,319 | B1 | 5/2002 | Hill, Jr. et al. | |
| 6,464,006 | B2 * | 10/2002 | Womble | 166/276 |
| 6,554,324 | B1 | 4/2003 | Herman | |
| 7,080,693 | B2 | 7/2006 | Walker et al. | |
| 7,426,964 | B2 | 9/2008 | Lynde et al. | |
| 7,997,344 | B2 * | 8/2011 | Corbett | 166/334.4 |
| 2003/0173089 | A1 * | 9/2003 | Westgard et al. | 166/381 |
| 2012/0012338 | A1 | 1/2012 | Blanton et al. | |
| 2012/0186824 | A1 * | 7/2012 | Allen et al. | 166/373 |

* cited by examiner

*Primary Examiner* — Nicole Coy
*Assistant Examiner* — Tara Schimpf
(74) *Attorney, Agent, or Firm* — Steve Rosenblatt

(57) ABSTRACT

A collet system is disabled from gaining profile support when moved between profiles that will be used ultimately to support an inner string at a desired plurality of locations. It is when the collet reaches a desired location that it is unlocked by virtue of inner string movement so that a profile on the outer assembly is engaged by a sleeve to induce relative rotation of the sleeve with respect to the mandrel that supports the sleeve. The relative rotation moves a tab into alignment with a slot to permit relative axial movement between the mandrel and the tool so that the tool can function as intended. The sleeve is engaged by another profile for further relative rotation to misalign the tab and the slot to lock the tool. The tool is preferably a support collet for a crossover in a multi-zone gravel pack.

14 Claims, 5 Drawing Sheets

RESETTABLE SELECTIVE LOCKING DEVICE

FIELD OF THE INVENTION

The field of the invention is a selectively operated lock for a downhole tool and more particularly a selective lock for a Smart® Collet when used in multiple zone completions.

BACKGROUND OF THE INVENTION

The details of the assembly and operation of Smart® Collets is described in detail in U.S. Pat. Nos. 6,382,319 and 6,464,006. In essence the collet lands at predetermined support locations in an outer screen assembly and is part of an inner string. For example, in U.S. Pat. No. 6,382,319 FIG. 1 the support locations are 36, 37 and 38 and their spacing is known as a single zone is being treated. However in multiple zone completions the spacing of the support locations intended to operate with the Smart® Collet may be unknown or the large spacing between zones with the potential of other tools being in the assembly that present potential unintended support locations for the Smart® Collet present problems to surface personnel in determining if the inner string assembly in a gravel pack is properly aligned so that gravel delivered through the frac port in the inner string will properly cross over to the outer annular space of the zone that needs the gravel packing. What is needed as provided by the present invention is a way to selectively prevent the Smart® Collet from supporting any load until it comes in proximity of the shoulder on which it is intended that it will support a load. At this point the lock is defeated to allow the Smart® Collet to function normally for proper crossover support at the desired zone to selectively circulate or squeeze or reverse out in the known manner as described in the aforementioned patents. While the preferred application will be described as being for a Smart® Collet in a multi-zone gravel packing operation, those skilled in the art will appreciate that there are broader applications for locks that selectively unlock and reset to respectively unlock and lock an associated tool for multiple operations at spaced subterranean locations.

Sleeves have been used for location and orientation of keys to insure that a given collet system only latches at a desired profile location as described in US Publication 2003/0173089 A1. In a different application a protective sleeve reduces the drift diameter to protect a release sleeve from catching a hold of the release sleeve inadvertently and moving it. A release tool is inserted through the release sleeve and into the protective sleeve inside diameter.

The protective sleeve has an inner spline for the release tool to be able to get past the release sleeve and get a grip on the release sleeve to shift it. This device is described in U.S. application Ser. No. 13/012,552.

What is needed and provided by the present invention is a simple lock and unlock feature for a subterranean tool that is located on a string delivering the tool that selectively allows the tool to operate as intended at predetermined locations and then locks the tool against operating as the tool is moved away from the desired location of operation. These and other aspects of the present invention will be more readily apparent to those skilled in the art from a review of the description of the preferred embodiment and the associated drawings while recognizing that the full scope of the invention is to be determined by the appended claims.

SUMMARY OF THE INVENTION

A collet system is disabled from gaining profile support when moved between profiles that will be used ultimately to support an inner string at a desired plurality of locations. It is when the collet reaches a desired location that it is unlocked by virtue of inner string movement so that a profile on the outer assembly is engaged by a sleeve to induce relative rotation of the sleeve with respect to the mandrel that supports the sleeve. The relative rotation moves a tab into alignment with a slot to permit relative axial movement between the mandrel and the tool so that the tool can function as intended. The sleeve is engaged by another profile for further relative rotation to misalign the tab and the slot to lock the tool. The tool is preferably a support collet for a crossover in a multi-zone gravel pack.

DETAILED DESCRIPTION OF THE PREFERRED EMBODIMENT

Figure 1:
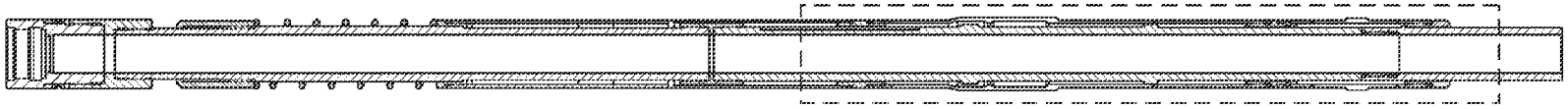
FIG. 1 is a section view of a known Smart® Collet with the selective lock feature shown at the right end.
Figure 2:
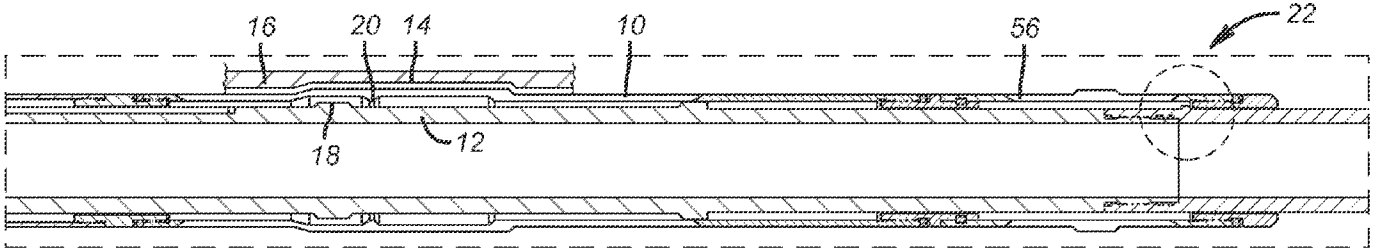
FIG. 2 is an enlarged view of the lock feature at the right end of FIG. 1.
Figure 3:
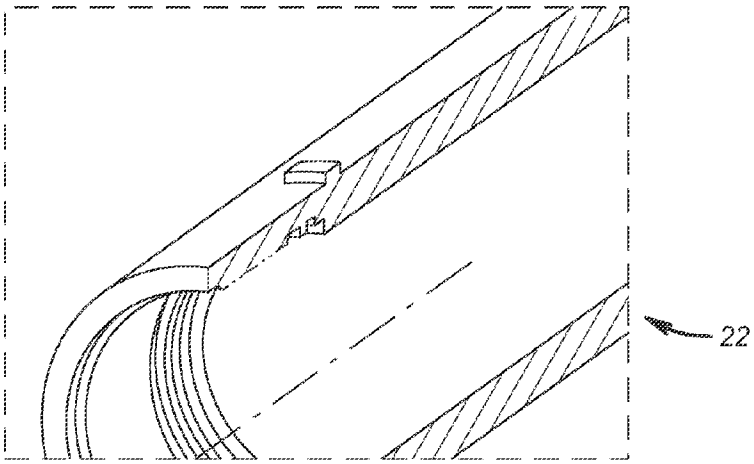
FIG. 3 is an enlarged view of the lock of FIG. 2 showing the tab that selectively advances axially when aligned with a slot for normal Smart® Collet operation.

Referring to FIG. 1 the Smart® Collet 10 is of a type known in the art and described in detail in U.S. Pat. Nos. 6,382,319 and 6,464,006. In operation, greatly simplified, the collet assembly is a movable member 10 that moves radially and relatively axially with respect to the mandrel 12 so that the collet assembly 10 can snap into profile 14 in the surrounding tubular 16. Once there is such engagement the mandrel 12 can be axially manipulated with respect to the collet assembly 10 now supported in profile 14. This relative axial motion can place support 18 in line with inner ring 20 on the collet assembly 10 to lock the collet assembly 10 in the profile 14. There are generally several such profiles 14 in spaced locations for a given zone to gravel pack to support the circulate, squeeze and reverse out positions of the crossover (not shown) that supports the collet assembly 10 through the mandrel 12 support 18 misaligned with ring 20 to then allow the collet assembly 10 to radially collapse and move out of the profile 14. The lock assembly 22 is supported by mandrel 12 and is designed to selectively permit or prevent relative axial movement between the mandrel 12 and the collet assembly 10. In the locked position the support 18 is held offset to ring 20 so that the collet assembly 10 cannot find support in any profile such as 14. When lock assembly 22 is released, the collet assembly 10 works as a known Smart® Collet.

Figure 10:
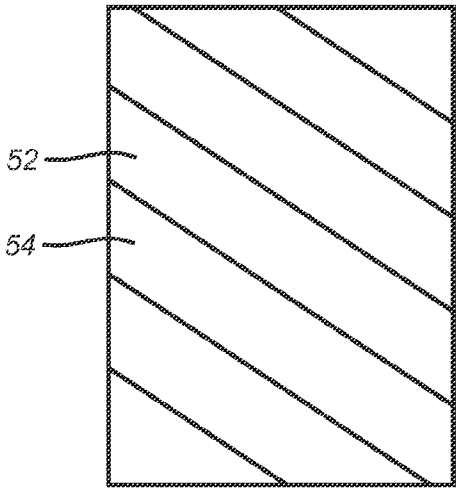
FIG. 10 is the interior view of the surrounding tubular profile shown in FIG. 9.
Figure 7:
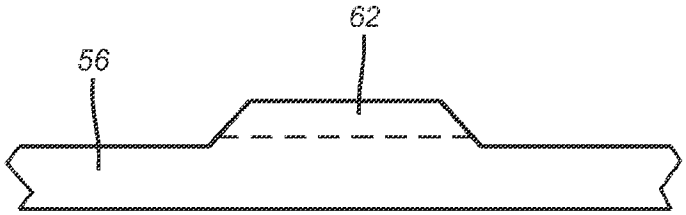
FIG. 7 is a section view of the extending helical profile of the rotating sleeve.
Figure 8:
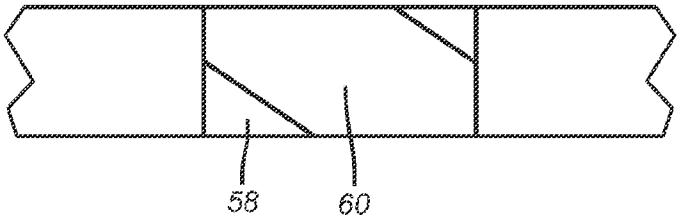
FIG. 8 is the exterior view of the helical profile on the rotating sleeve.
Figure 11:
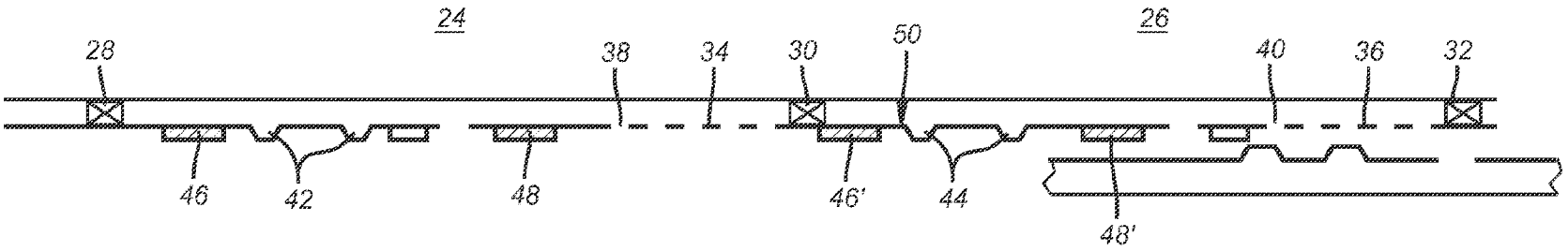
FIG. 11 shows a two zone gravel packing application of the lock system of the present invention with the Smart® Collet in the locked position.

An assembly for two zones 24 and 26 is illustrated in FIG. 11. Zone 24 is between packers 28 and 30 and zone 26 is between packers 30 and 32. Screens 34 are in zone 24 and screens 36 are in zone 26. The screens 34 and 36 respectively have openings 38 and 40 above to allow gravel slurry or other fluids to pass into the outer annulus in the borehole that reaches the zones 24 and 26. The collet assembly 10 engages profile 42 in zone 24 or profile 44 in zone 26 in a known manner. However, above and below profile 42 are spiral profiles 46 and 48 on the outer assembly 50. FIG. 11 shows profile 46 for example in section and FIG. 10 shows the inside view showing the adjacent and alternating peaks 52 and valleys 54. Preferably there is a constant pitch to the pattern. The patterns at profiles 46 and 48 can be identical or the pitch on one can be the reverse of the pitch on the other. As shown in FIGS. 1, 7 and 8, a rotating sleeve 56 is mounted to mandrel 12 and has alternating peaks 58 and valleys 60 on profile 62 that can have the same pitch as profile 46 or 48 or both. If the pitch on profiles 46 and 48 is in the same direction then movement of the sleeve 56 in the same direction past profiles 46 and 48 will turn sleeve 56 in the same direction as profile 62 engages them. Alternatively if the pitch on profiles 46 and 48 are opposite hand then movement of mandrel 12 in the same direction past profile 46 will see initial rotation in a first direction of the sleeve 56 due to engagement of profile 62 followed by a reversal of direction for rotation back to the initial position when profile 62 engages profile 48. Preferably the pattern in zone 26 is identical to the pattern in zone 24.

Figure 4:
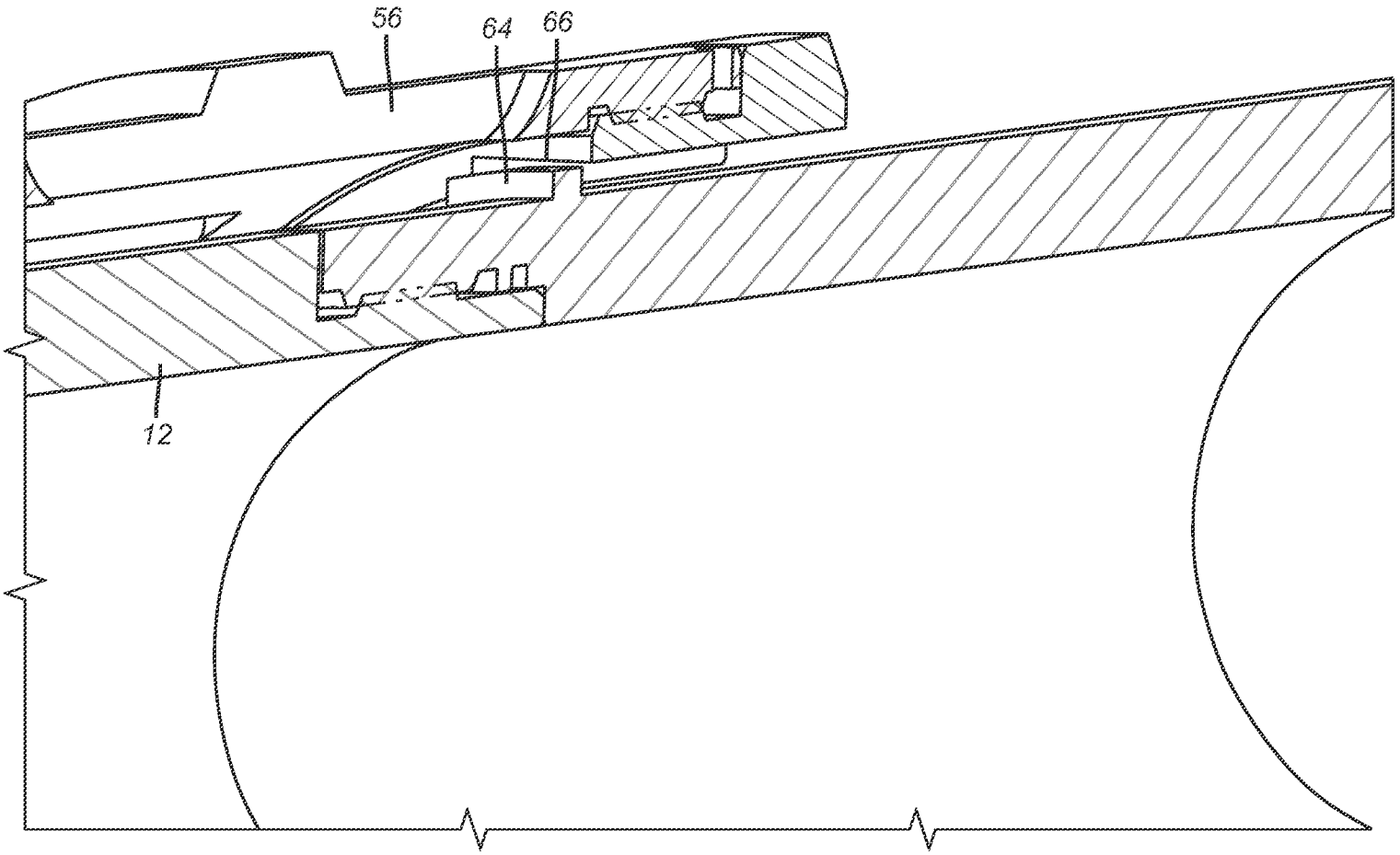
FIG. 4 shows a perspective of the rotating sleeve assembly that puts an axial slot into or out of alignment with the tab shown in FIG. 3.
Figure 6:
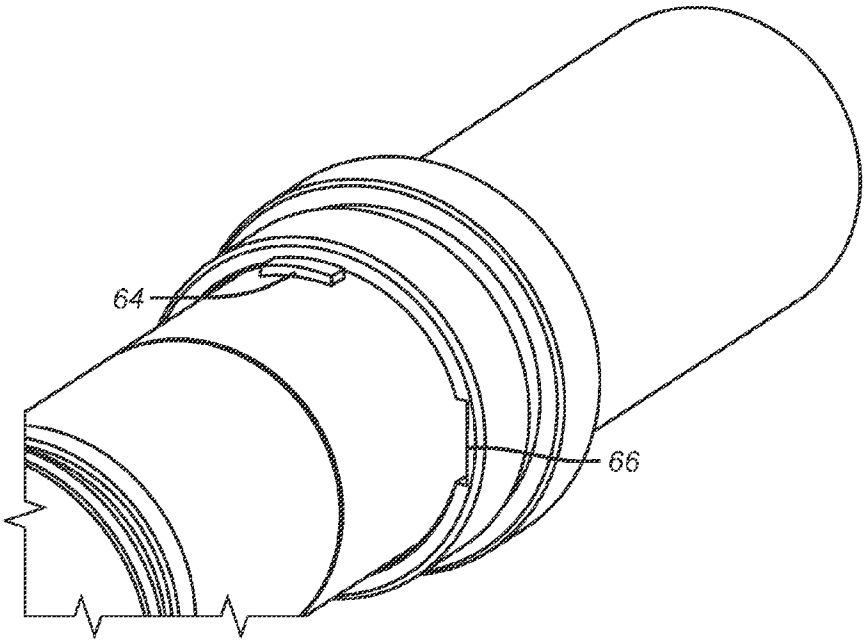
FIG. 6 shows a misaligned tab and axial slot.
Figure 5:
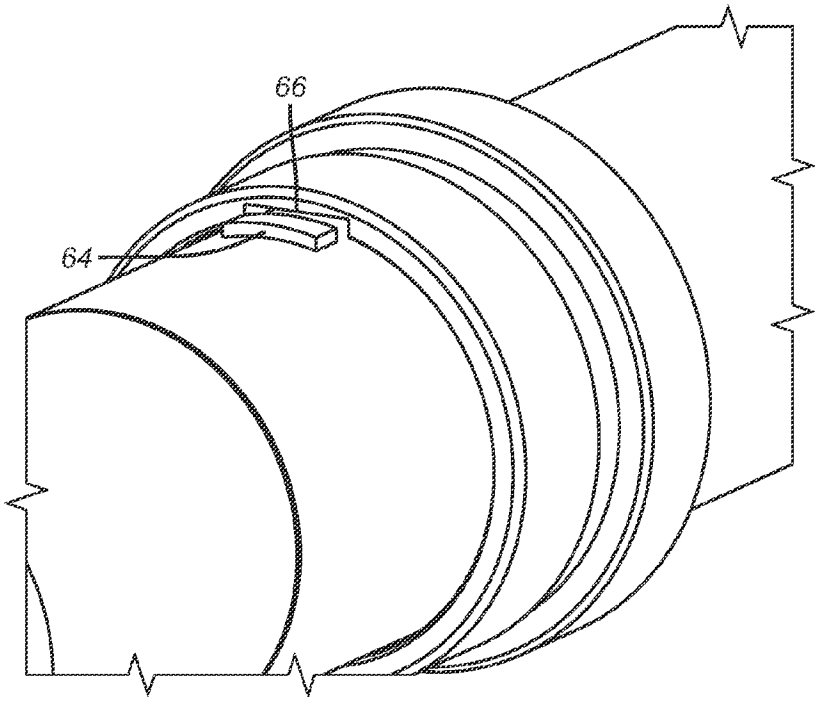
FIG. 5 shows an aligned tab and axial slot.
Figure 9:
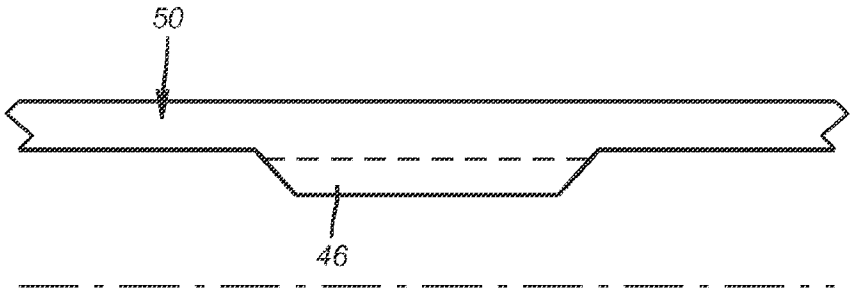
FIG. 9 is a section view of a surrounding tubular profile that is engaged by the extending helical profile of FIG. 7.
Figure 12:
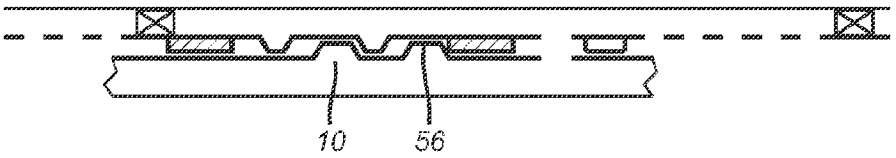
FIG. 12 is the view of FIG. 11 with the Smart® Collet unlocked and supporting a crossover in a profile so that the frac port aligns with the port above the screens to the outer annulus of the lower zone.
Figure 13:
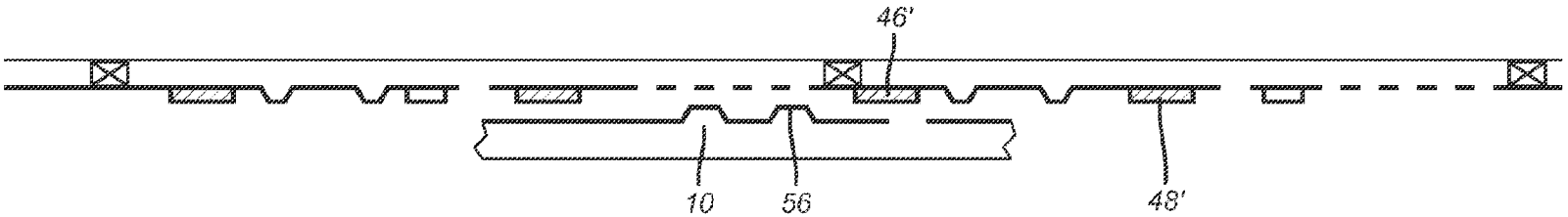
FIG. 13 is the view of FIG. 12 after the lower zone is completed with the Smart® Collet locked for movement to the next zone uphole.

FIG. 4 shows the rotating sleeve 56 that is axially retained on the mandrel 12. Mandrel 12 has an exterior tab 64. Axial movement of the mandrel 12 to bring profile 62 into contact with profile 48 brings a slot 66 into alignment with tab 64 to in turn permit relative axial movement between the mandrel 12 and the collet assembly 10 to allow normal Smart® Collet operation in zone 24 just as the collet assembly 10 comes into the vicinity of the support locations 42 in zone 24. This normal operation is shown illustratively in FIG. 12 for the lower zone 26 which would normally be treated first. The same process occurs in zone 24. FIG. 13 shows the inner string of mandrel 12, collet assembly 10 and lock assembly 22 moving sufficiently to get sleeve 56 with its profile 62 past the profile 48' to turn the sleeve 56 either in the same direction as engagement with profile 46' had caused earlier or back in the opposite direction for the same amount of rotation. Regardless of the direction of the second rotation of sleeve 56 in a given zone the desired result is to get tab 64 misaligned with slot 66 as in FIG. 6. FIG. 5 shows alignment of tab 64 with slot 66 for normal Smart® Collet operation. Since there can be multiple slots 66 sleeve rotation in the same direction will alternately bring alignment of tab 64 with different slots 66. If in a given zone the sleeve 56 rotates one way for alignment and in reverse for misalignment then only one slot 66 is necessary. Thus for movement between zones 24 and 26, the FIG. 6 position prevents the collet assembly 10 of the smart collet from getting a supporting grip on any profile or radial surface along the way. It is not until another spiral profile such as 48 in the upper zone 24 is engaged that the collet assembly 10 is able to find support as relative movement between the mandrel 12 and the collet assembly 10 again makes possible alignment of support 18 with inner ring 20.

Those skilled in the art will appreciate that the invention seeks to keep a tool in a locked position when being moved past areas where premature operation is not desirable. The lock system can unlock and relock to allow normal tool operation in a desired zone while preventing operation for any reason when away from desired zones of operation. It is particularly adept at dealing with multiple completion zones where a crossover has to take several positions in a particular zone to accomplish the circulation, squeeze and/or reverse out positions. Mere axial movement is automatically converted to rotation that selectively locks or unlocks the associated tool, which in the preferred embodiment is the Smart® Collet with sleeve rotation in the same or in opposite hand rotation. While the preferred way to accomplish the rotation is with spirally meshing splines is preferred other ways are contemplated such as a j-slot for example. The benefit of the present invention is the simplicity and the automatic nature of the operation so that that a problem of the Smart® Collet getting a support where it is not desired are eliminated. In essence a pair of activating profiles such as 48 and 46 in a movement of the inner string with the Smart® Collet respectively enable normal operation and then disable normal operation by locking the collet assembly 10 to the mandrel 12 to prevent unintended operation at anywhere but the intended support locations such as at multiple zones 24 and 26. Those zones can be far apart with several radial surfaces in between where the Smart® Collet could otherwise be engaged to find support for the inner string but for the presence of the lock assembly 22 of the present invention.

The above description is illustrative of the preferred embodiment and many modifications may be made by those skilled in the art without departing from the invention whose scope is to be determined from the literal and equivalent scope of the claims below:

I claim:

1. A subterranean tool comprising a lock assembly wherein said lock assembly comprises relatively moveable components to enable support of a collet assembly at one or more desired subterranean locations of a surrounding tubular defining a wall in a borehole and to prevent operation of said collet assembly for support from the wall during movement outside said one or more subterranean locations, comprising:

An enabling profile and a disabling profile spaced from each other and defining a profile pair associated with the wall defined by the tubular to define at least one desired subterranean location therebetween on the tubular such that an operating profile on the wall defined by the tubular and located within said profile pair, wherein said operating profile can be engaged for support by said collet assembly by virtue of movement enabled by said relatively moveable components, which comprises a sleeve and a mandrel, whereby said sleeve moves relatively to said mandrel independently and separately from said collet assembly before said collet assembly is located at said at least one operating profile and after the tool has passed said at least on enabling profile, said enabling profile reorienting said sleeve to permit relative axial movement between said mandrel and said collet assembly to permit support of said collet assembly when said at least one operating profile is engaged by said collet assembly whereupon release of said collet assembly from said at least one operating profile and further tool movement past an adjacent said at least one disabling profile, said sleeve is further relatively moved to prevent sufficient axial relative movement by said mandrel with respect to said collet assembly which would otherwise allow said collet assembly to find support in the tubular.

2. The assembly of claim 1, wherein:

said relative axial movement occurs with mandrel movement while said collet assembly is externally supported in a subterranean location.

3. The assembly of claim 2, further comprising:

said sleeve rotatably mounted over said mandrel and one of said rotatably mounted sleeve and said mandrel having at least one axial slot and the other of said rotatably mounted sleeve and said mandrel having at least one tab, whereupon selective alignment of said tab and said slot allows said collet assembly to function by enabling said axial relative movement.

4. The assembly of claim 3, wherein:

said sleeve is rotated by contact with said at least one enabling and said at least one disabling profiles.

5. The assembly of claim 4, wherein:

said rotation upon contact with said at least one of enabling and disabling profiles is in the same or opposite direction.

6. The assembly of claim 4, wherein:

said rotation is caused by meshing helical splines on said sleeve on one hand and on said at least one enabling and disabling profiles on the other hand.

7. The assembly of claim 3, wherein:

said tab is mounted to said mandrel and said sleeve has said at least one axial slot.

8. The assembly of claim 6, wherein:

said collet assembly when supported in said at least one operating profile selectively supports said mandrel.

9. The assembly of claim 8, wherein:

alignment of said tab and said slot allows mandrel axial movement to support said collet at multiple locations on support surfaces in an outer screen assembly in one or more desired subterranean locations, while misalignment of said tab and slot prevents relative axial movement between said mandrel and said collet to prevent said collet from supporting said mandrel outside of said desired subterranean locations.

10. The assembly of claim 1, wherein:

said subterranean tool comprises a plurality of said enabling profiles and a plurality of said disabling profiles wherein said plurality of enabling profiles and said plurality of disabling profiles define a plurality of said profile pairs;

said sleeve rotatably mounted to said collet assembly for selective engagement with at least one of said plurality of enabling profiles and with at least one of said plurality of disabling profiles of at least one of said plurality of profile pairs such that sleeve rotation both enables and disables relative movement between said mandrel and said collet assembly.

11. A lock assembly, comprising relatively movable components, of a subterranean tool to enable operation of a collet assembly on said tool at one or more desired subterranean locations of a surrounding tubular defining a wall in a borehole and to prevent operation of said collet assembly for support from the wall during movement outside said one or more subterranean locations comprising:

at least one spaced enabling and disabling profiles defining at least one profile pair associated with the wall defined by the tubular and spaced apart to define at least one desired subterranean location on the tubular such than an operating profile on the wall, defined by the tubular and located within said profile pair, can be engaged for support by said collet assembly by virtue of movement enabled by said relatively movable components, wherein said relatively moveable components further comprise a mandrel and a sleeve, wherein after said sleeve has passed said at least one enabling profile, said mandrel is allowed to move axially relative to said collet assembly which is supported on said operating profile, whereupon release of said collet assembly from said operating profile and further sleeve movement past an adjacent said at least one disabling profile, said mandrel cannot relatively move sufficiently relative to said collet assembly to allow said collet assembly to find support in the tubular; said sleeve rotatably mounted to said mandrel for selective engagement of said collet assembly with said at least one profile pair such that sleeve rotation both enables and disables said relative movement between said mandrel and said collet assembly for support of said collet assembly; said sleeve and said at least one profile pair comprise helical splines to rotate said sleeve as said subterranean tool moves axially within the wellbore.

12. The assembly of claim 11, wherein:

one of said sleeve and said mandrel having at least one axial slot and the other of said sleeve and said mandrel having at least one tab, whereupon selective alignment of said tab and said slot allows said collet assembly to function, while misalignment of said at least one slot and said at least one tab prevents operation said collet assembly.

13. The assembly of claim 12, wherein:

said collet assembly when supported in said at least one operating profile selectively supports said mandrel.

14. The assembly of claim 13, wherein:

alignment of said tab and said slot allows mandrel axial movement to support said collet at multiple locations on support surfaces in an outer screen assembly in one or more desired subterranean locations, while misalignment of said tab and slot prevents relative axial movement between said mandrel and said collet to prevent said collet from supporting said mandrel outside of said desired subterranean locations.

* * * * *